United States Patent [19]

O'Barr

[11] 4,289,315

[45] Sep. 15, 1981

[54] GOLF SIMULATING GAME

[76] Inventor: Vernon L. O'Barr, 360 Park Central, Mira Loma, Calif. 91752

[21] Appl. No.: 172,677

[22] Filed: Jul. 28, 1980

[51] Int. Cl.[3] ..... A63F 1/04; A63F 1/10

[52] U.S. Cl. ..... 273/298; 273/148 A

[58] Field of Search ..... 273/148 A, 298, 245

[56] References Cited

U.S. PATENT DOCUMENTS

| | | | |
|---|---|---|---|
| D. 160,906 | 11/1950 | Ungar | 273/148 A |
| 1,597,457 | 8/1926 | Moorman | 273/298 X |
| 1,903,744 | 4/1933 | Heusser et al. | 273/148 A |
| 2,624,582 | 1/1953 | Molinar | 273/148 A |

FOREIGN PATENT DOCUMENTS

| | | | |
|---|---|---|---|
| 340045 | 12/1930 | United Kingdom | 273/298 |

*Primary Examiner*—Anton O. Oechsle

*Attorney, Agent, or Firm*—William C. Babcock

[57] ABSTRACT

A game that simulates actual play of a round of golf in which the players mutually agree to play a course selected from a group of course cards of well known golf courses, each of which cards indicates the number of holes on the course, the yardage of each hole, and the par for each hole. A number of decks of opaque playing cards are provided, each of the decks being different from the balance thereof. Each deck includes a number of cards that have first and second sides. The first sides of the cards in each deck are identical and bear an insignia that indicates a particular act performed in playing a game of golf, such as driving, putting and the like. The second sides of the cards in each deck carry a variety of messages indicating the progress that has been made in achieving the act of golf indicated on the first sides of the cards of that deck. A pivotally supported, compartmented, tray is provided that has a number of playing compartments situated thereon in which the decks are positioned, with the first sides of the cards facing outwardly. The tray also has a number of discard compartments in which cards of like identifying insignia are placed after the players in succession draw cards from the playing compartments, expose the drawn cards to the balance of the players and continue to play in succession in accordance with recognized rules of golf.

1 Claim, 5 Drawing Figures

GOLF SIMULATING GAME

BACKGROUND OF THE INVENTION

1. Field of the Invention

Golf simulating game.

2. Description of the Prior Art

In certain geographical areas of the world, golf can only be played a portion of the year due to inclement weather conditions. Also, many players that are interested in golf are prevented by physical disabilities or otherwise from engaging in the actual playing of the game.

A major object of the present invention is to provide a game available to one or more players of all ages and physical conditions that when played simulates actual playing of a round of golf, and the same being available for play at all times irrespective of weather conditions.

Another object of the invention is to provide a game that provides a challenge to professional golfers, amateurs, men, women and children; that is exciting; and further increases the users interest in golf and the skill necessary in achieving proficiency therein.

A still further object of the invention is to supply a game that may be played by the persons above identified, and one that will develop an exciting challenge among the players engaged in the game.

These are other objects and advantages of the invention will become apparent from the following description thereof.

SUMMARY OF THE INVENTION

The present invention is a game that simulates the actual playing of a round of golf over a course for which a course card is provided which course card as is conventional with those used at well known clubs includes a list of the holes of the course by numbers, the distance in yards to each hole, and par for each particular hole. A number of decks of playing cards are provided, with each card in each deck having first and second sides, the first sides of the cards in each deck being identified by a like insignia that visually indicates a particular act performed in the playing of a round of golf, and the second sides of the cards in each deck having a number of different messages thereon that indicate the degree of success achieved in carrying out the particular act indicated on the first side of the card. The course card and the combination of decks of cards above identified are used in conjunction with a game device of the present invention that permits one or more players grouped about a horizontal surface, such as a table top to play the golf simulating game.

The playing device includes a tray that is preferably elongate in shape and defines a sequence of longitudinally extending playing compartments that are oppositely disposed from a like number of discard compartments. The playing compartments and discard compartments are preferably laterally spaced from one another and define a recessed area therebetween in which score cards and decks of the playing cards may be stored when not in use.

The tray is pivotally supported on a base that rests on a horizontal flat surface such as the top of a table or the like.

One of the players after a course card for a particular course is selected by chance, such as throwing a die, flipping a coin or the like, is nominated to be scorekeeper. A score is kept in the same manner as in actual playing golf. The elected scorekeeper has the honor of starting the game.

The decks of cards are placed in the playing compartments with the first sides of the cards in the decks facing outwardly.

The players starting with the scorekeeper in succession draw appropriate cards from the decks and lay the drawn cards on the horizontal surface where the second sides thereof upwardly dispose so that the balance of the players may see the progress that a particular player has achieved in progressing towards a particular hole.

The above described operation is repeated hole by hole, with the scorekeeper recording the number of cards drawn by each player to complete a hole, which number corresponds to the number of strokes taken by a player if an actual game of golf was being played. The played cards ae returned to appropriate discard compartments in the tray after the playing of each hole as above described, to prevent confusion with cards later to be drawn from the playing compartments as the game progresses. The player or group of players with the lowest number of strokes as shown on the cards completing the 18 holes is the winner. The game of the present invention may be used by the players to play match play (by the hole) or medal play (total score). Variations that may be used by the players with the game are: (a) a single player (b) partners (c) partners best ball (d) foursome best ball (e) partners selective drive (f) foursome selective drive and so forth. No handicaps will normally be allowed in the playing of the game, and the game will be played in accordance with well known rules, such as those of the United States.

DESCRIPTION OF THE SPECIFIC EMBODIMENT

The game of the present invention is played in conjunction with a selected one of a number of convential course cards A of well known golf courses, each of which cards would indicate the number of holes on the course, the yardage for each hole, and par for that particular hole.

Figure 4:
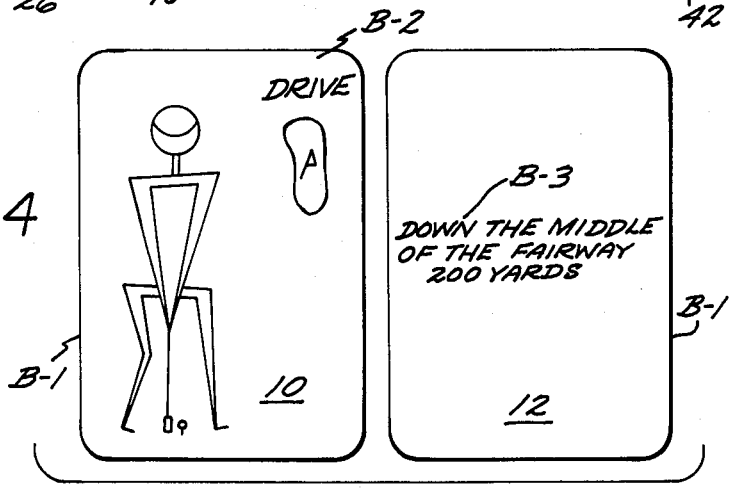
FIG. 4 is a plan view of one of the playing cards, with the view illustrating both the first side thereof that indicates a particular act of golf, and a second side of the card that carries a message indicating the progress the player has made towards a particular hole.
Figure 5:
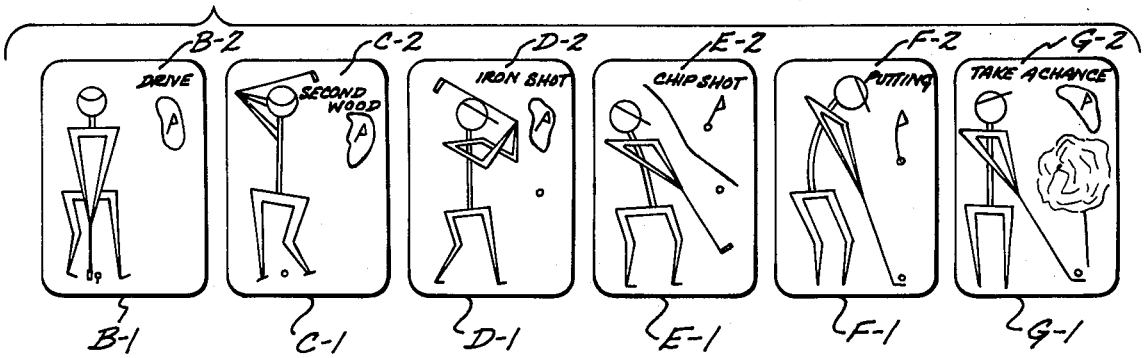
FIG. 5 is a top plan view of the first sides of a number of decks of cards used in playing the golf simulating game that utilizes the tray illustrated in FIG. 1.

In addition, a number of decks of opaque cards are provided. In the drawing six decks of cards are illustrated as being used, first, second, third, fourth, fifth and sixth decks being identified by the letters B,C,D,E,F,G. The cards in each deck are identified as having first sides 10 and second sides 12. The cards in each deck are further identified as may be seen in FIG. 5 by the notations B-1, C-1, D-1, E-1, F-1, and G-1. All of the cards in the first deck B-1 have an insignia B-2 on the first sides 10 thereof which indicates "drive". Second cards C-1 in the second deck C have insignias C-2 on the first sides 10 thereof which indicate "secondwood". Likewise the first sides 10 of the third cards D-1 carry the notation "iron shot" B-2 on the first sides thereof. The fourth cards E-1 have insignias E-2 on the first sides 10 thereof which indicate "chip shot". The fifth cards F-1 on the first sides 10 thereof carry insignias "F-2" which is "Putting". The sixth cards G-1 on the first sides 10 thereof carry an insignia G-2 "take a chance". Each of the cards in the six decks above identified on the second side 12 thereof carry a message B-3, one of which messages is illustrated in FIG. 4, as "down the middle of the fairway, 200 yds". The messages B-3 that may be imprinted on the back of each of the six decks of cards previously identified will be further described in detail later in the specification.

Figure 1:
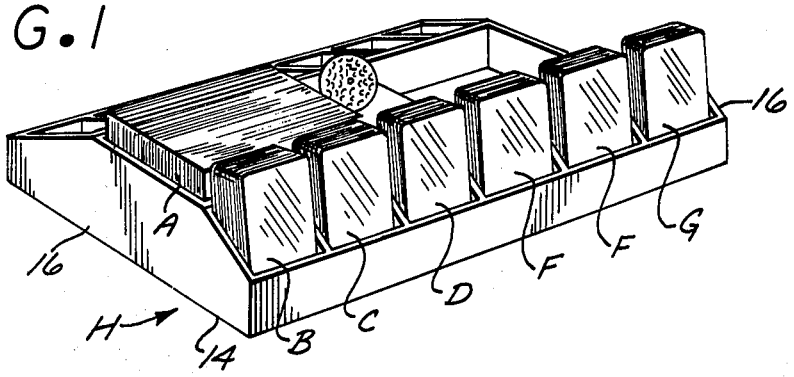
FIG. 1 is a perspective view of the tray assembly, and the cards used in playing the game that simulates the actual playing of a round of golf.
Figure 2:
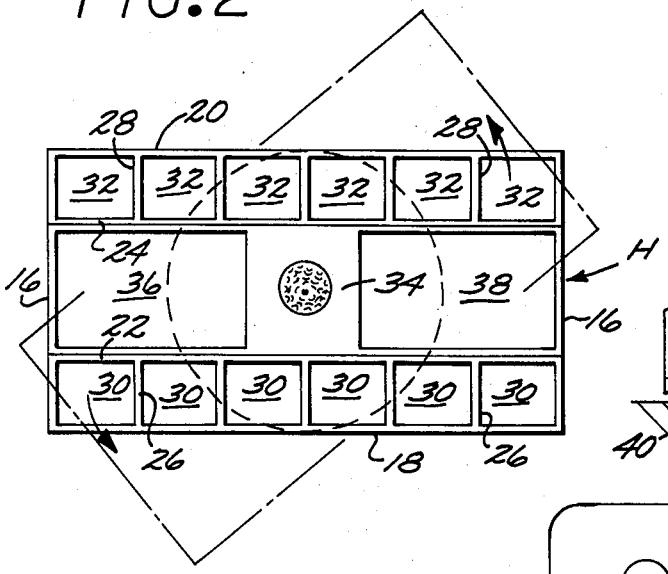
FIG. 2 is a top plan view of the tray assembly.
Figure 3:
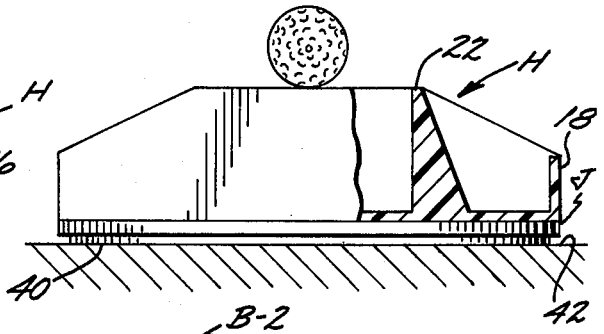
FIG. 3 is an end elevation view of the assembly with a portion thereof cut away to illustrate the internal structure of the tray.

The decks of cards above described are used in conjunction with a tray assembly H which is shown in FIGS. 1 to 3 inclusive of the drawing. The tray assembly H includes a flat rectangular bottom 14, a pair of end walls 16 that extends upwardly from the bottom, a first side wall 18, and a second side wall 20 that extends upwardly from the longitudinal edges of the bottom. The tray assembly H includes third and fourth side walls 22 and 24, which as may be seen in FIG. 2 are disposed inwardly from the first and second side walls 18 and 20. A number of transverse first partitions 26 extend between the first side wall 18 and third side wall 22 as shown in FIG. 2 to define in conjunction with the pair of end wall 16 a number of playing compartments 30. A number of second partitions 28 co-operate with the second and fourth side walls 20 and 24 and a pair of end walls 16 to define a number of discard compartments 32 in which the various cards from the decks B to G inclusive are deposited after the cards have been drawn, exposed to the players and the playing of a hole is completed. In FIG. 2 it will be seen that a cross piece or divider 34 extends between the third and fourth side walls 22 and 24. The divider 34 in conjunction with the second and third side walls 22 and 24, and the pair of end walls 16, as well as the bottom 14 define first and second cavities or recess areas 36 and 38 in which the cards may be stored when the assembly H is not in use. The assembly H further includes a base 40 that is illustrated as being round and is adapted to rest on a flat horizontal surface 42 such as a top of a table or the like, and the tray assembly being pivotally supported from the base by pivotally supporting means J.

Typical messages on the decks B to G are as follows,

First Deck B, B-2 "Drive", B-3 Message

4 WOW! Down the middle of the Fairway 280 yds
8 BEAUTIFUL DRIVE Down the Middle of the Fairway 250 yds
5 Down the Middle of the Fairway 235 yds
7 Down the Middle of the Fairway 230 yds
10 Down the Middle of the Fairway 225 yds
10 Down the Middle of the Fairway 220 yds
7 Down the Middle of the Fairway 200 yds
5 Down the Middle of the Fairway 180 yds
2 Down the Middle of the Fairway 170 yds
4 Topped the Ball Use Second Wood
2 Sliced Out of Bounds 2 Stroke Penalty DRIVE AGAIN
2 Hooked Out of Bounds 2 Stroke Penalty DRIVE AGAIN
2 Missed The Ball DRIVE AGAIN
2 You are in the Trees Made it Thru USE CHIP
2 Teed Up to Front of the T Markers and Hit the Ball 1 Stroke Penalty
4 Behind a Tree 1 Stroke Penalty or TAKE A CHANCE
4 Sliced into the Rough 1 Stroke Penalty or TAKE A CHANCE
4 Hooked into the Rough 1 Stroke Penalty or TAKE A CHANCE
3 In the Trap 1 Stroke Penalty or TAKE A CHANCE
3 In the Water 1 Stroke Penalty or TAKE A CHANCE
90 TOTAL cards Second Deck C, C-2 "Second Wood" C-3 Messages 12 You are On the Green
7 Down the Middle Use Chip
7 You are in the Trap Use Chip
4 You are in the Trees You Chipped Out Use Iron
3 You are in the Trees You Made it thru You are on the Green
1 You are IN THE HOLE
4 You are in the Water 1 Stroke Penalty Use Iron
5 You are in the Water 1 Stroke Penalty Use Chip
2 You Hit Behind and Ball Hit Again
2 You Topped the Ball Hit Again
3 Hooked Out of Bounds 2 Stroke Penalty Hit Again
3 Sliced Out of Bounds 2 Stroke Penalty Hit Again
60 TOTAL cards Third Deck D, D-2 "Iron Shot", D-3 Messages 25 ON THE GREEN
10 YOU ARE CLOSE TO THE HOLE
3 IN THE HOLE
15 CAME UP SHORT USE CHIP
7 THE BALL WENT OVER THE GREEN CHIP
10 YOU LANDED IN THE TRAP CHIP
4 YOU LOOKED UP HIT AGAIN WITH IRON
4 YOU LOOKED UP USE CHIP
4 YOU SHANKED THE BALL USE CHIP
2 YOU HIT BEHIND THE BALL USE CHIP
2 YOU HIT FAT HIT AGAIN
86 TOTAL cards Fourth Deck E, E-2 "Chip Shot", E-3 Messages 25 ON THE GREEN
8 CLOSE TO THE HOLE
15 CAME UP SHORT OF GREEN YOU CAN PUTT
5 IN THE HOLE
10 OVER THE GREEN INTO THE TRAP CHIP AGAIN
5 HIT UNDER THE BALL CHIP AGAIN
5 LOOKED UP CHIP AGAIN
2 CLOSE TO THE HOLE TAP IT IN
75 TOTAL cards Fifth Deck F, F-2 "Putting", F-3 Messages 15 IN THE HOLE
15 ALMOST IN THE HOLE TAPE IT IN
10 TO HARD PUTT AGAIN
10 TO SHORT PUTT AGAIN 40 2 PUTT
90 TOTAL cards Sixth Deck G, G-2 "Take a Chance", G-3 Messages 10 ON THE GREEN
15 IN THE FAIRWAY USE IRON
10 IN THE TRAP USE CHIP
5 CAME UP SHORT USE CHIP
3 ON APRON OF GREEN YOU CAN PUTT
2 LOST BALL 2 STROKES PENALTY
1 MISSED TRY AGAIN
1 IN THE HOLE
1 NEAR THE HOLE YOU CAN TAP IT IN
50 TOTAL Cards The game is played as follows. The first to sixth decks B–G inclusive are shuffled and placed in the players compartments 30 as may be seen in FIGS. 1 and 2. The first to sixth decks B–G inclusive have the first sides 10 disposed outwardly. A scorekeeper is selected from one of the players by chance, such as rolling a dice, flipping a coin, or otherwise. The person who is elected to keep score reads from one of the course cards A that has been selected the number of the hole that is to be played, the distance in yards to the hole, and par for that hole. The player who has been selected as scorekeeper also has the starting honors, and draws a card B-1 from the playing compartment 30 in which it is positioned and places it on the horizontal surface 42 where the second side 12 thereof face up so that the balance of the players may see the message B-3 on the second side 12 thereof. If the hole is identified as a par 3 hole, the first card drawn will be from the third deck D that has the insignia D-2 "iron shot" thereon. After the first player has taken his card the second player to his left (clockwise) draws an appropriate card from the playing of the particular course with this a procedure continued on and around the table until all other players have drawn cards indicating that they have "teed" off. It will be apparent that during this sequential selection of cards, that the tray assembly H will be pivoted to permit the decks of cards to be placed in convenient reach of the players. The game is continued hole by hole in the same manner until the completion of all of the holes on the selected course card A, with the scorekeeper recording the cards drawn by each player. Each card drawn corresponds to a stroke in actual playing of a game of golf. The player or group of players with the lowest number of drawn cards is the winner.

The use and structure of the game has been described previously in detail and need not be repeated.

What is claimed is:

1. In a game that simulates the actual playing of a round of golf over a course for which a course card is provided that lists the holes by number, distance in yards, and par, a plurality of decks and opaque playing cards, each card in each deck having first and second sides, said first sides of said cards in each of said decks being identified by an insignia that visually indicates the same particular act in the playing of a game of golf and said second sides of said cards in each of said decks having a plurality of different printed messages thereon that indicate the degree of success achieved in carrying out said particular act identified on said first side thereof, the combination with said plurality of decks and said course card of a device that preferably permits a plurality of players grouped about a horizontal surface to play said game, said device including:

a. a tray assembly that includes a flat rectangular bottom that has a pair of end edges and first and second side edges; a pair of end walls that extend upwardly from said ends; first and second side walls of substantially less height than that of said cards that extend upwardly from said first and second side edges; third and fourth side walls that extends upwardly from said bottom and disposed inwardly a substantial distance from said first and second side walls, said third and fourth side walls of substantially greater height than said first and second side walls; a plurality of longitudinally spaced first transverse partitions that extend between said first and third side walls and in co-operation with the latter and said end walls define a plurality of playing compartments in which said plurality of decks are removably disposed in inwardly inclined positions with said first sides facing outwardly; and a plurality of longitudinally spaced, transverse second partitions that extend between said second and fourth side walls and in co-operation with the latter and said end walls define a plurality of discard compartments in which said cards are placed after being played;

b. a base that may be disposed to rest on said horizontal surface; and c. means for pivotally supporting said tray on said base to permit said playing compartments to be successively positioned before each player to permit him to draw a card after the hole number has been announced from said course card, the yards therefor, and par therefor, said cards as drawn by said players being laid on said horizontal surface with said second sides up until play for said hole is completed in accordance with a predetermined set of rules selected by said players such as the United States Golf Associated rules, with the laid out cards after the scores for each hole has been determined being returned to said discard compartments, and play continued successively on each of said holes as above described until all of said holes on said course card have been played, with the drawing of each card being equivalent to a stroke if golf was actually played, and the player or group of players having the lowest number of strokes being the winner.

* * * * *